US006696652B1

(12) United States Patent
Spies

(10) Patent No.: US 6,696,652 B1
(45) Date of Patent: Feb. 24, 2004

(54) DEVICE FOR ACTIVATING AN OPENING MECHANISM AND/OR A CLOSING MECHANISM FOR LOCKABLE MOVING PARTS ON VEHICLES, SUCH AS FLAPS, DOORS OR SIMILAR

(75) Inventor: Wolfgang Uwe Spies, Haan (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/009,033

(22) PCT Filed: May 4, 2000

(86) PCT No.: PCT/EP00/03983

§ 371 (c)(1),
(2), (4) Date: Oct. 8, 2001

(87) PCT Pub. No.: WO00/70633

PCT Pub. Date: Nov. 23, 2000

(30) Foreign Application Priority Data

May 18, 1999 (DE) ..... 199 22 657
Dec. 18, 1999 (DE) ..... 199 61 246

(51) Int. Cl.[7] ..... H01H 3/16
(52) U.S. Cl. ..... 200/61.62; 200/330; 200/333

(58) Field of Search ..... 200/333, 302.2, 200/332.2, 330, 61.62

(56) References Cited

U.S. PATENT DOCUMENTS

| | | | | |
|---|---|---|---|---|
| 3,654,415 A | * | 4/1972 | Hawkins et al. | 200/332.2 |
| 4,713,509 A | * | 12/1987 | Chebowski | 200/333 |
| 5,448,028 A | | 9/1995 | Filion et al. | |
| 5,489,754 A | * | 2/1996 | Dirmeyer et al. | 200/302.2 |
| 5,498,844 A | * | 3/1996 | Chan | 200/330 |
| 5,784,891 A | * | 7/1998 | Lee | 200/333 |

FOREIGN PATENT DOCUMENTS

| | | |
|---|---|---|
| FR | 2217784 | 9/1974 |
| GB | 2161122 | 1/1986 |
| WO | 9711473 | 3/1997 |

* cited by examiner

*Primary Examiner*—Renee Luebke
(74) *Attorney, Agent, or Firm*—Friedrich Kueffner

(57) ABSTRACT

The invention relates to a device for activating an opening mechanism for lockable moving parts on vehicles. The device has a manual activator, which acts on a contact sensor (13) of a switch (12) for activation purposes. An outer skin (40) is provided on the vehicle. A part (43') of the actual outer skin (40) is made elastically deformable (43') and this part (43') is used as the activator for the switch (12).

21 Claims, 7 Drawing Sheets

DEVICE FOR ACTIVATING AN OPENING MECHANISM AND/OR A CLOSING MECHANISM FOR LOCKABLE MOVING PARTS ON VEHICLES, SUCH AS FLAPS, DOORS OR SIMILAR

BACKGROUND OF THE INVENTION

1. Field of the Invention

The invention relates to a device for activating an opening mechanism and/or a closing mechanism for lockable moving parts on vehicles. The device includes a manual actuator which, upon its actuation, acts on a switch and switches on a drive for opening or closing the movable vehicle part. Such a drive can belong to a closure which is embodied as a rotary latch. The rotary latch is secured by a locking pawl in the locking position and, upon activating the actuator, is transferred into an opening position. Such a device is, for example, used at the rear hatch of a motor vehicle.

2. Description of the Related Art

In the known device of this kind (DE 34 40 442 A1) the actuator is a pushbutton which is arranged in a hole in the outer skin. In order to secure the pushbutton in its initial position, a pressure spring is required. In order to protect the mechanism against dirt and moisture, the pushbutton is covered by a foil and sealed. Upon actuating the pushbutton, a ball is moved which acts on a contact maker of a switch which is arranged adjacent to the pushbutton. This known actuator comprises several components which must be manufactured separately and assembled with one another. Despite the elastic cover, dirt and moisture can enter the hole of the outer skin.

Moreover, in devices of the kind mentioned further decorative elements can be provided before, on and/or within the outer skin of the vehicle which serve for embellishing or provide a visual information content. A typical example for this is a company emblem.

SUMMARY OF THE INVENTION

In a device of the latter kind (DE 197 22 503 A1) the decorative element is comprised of a company emblem which is supported rotatably on the outer skin which in its initial position covers a lock body relative to the exterior. The company emblem can be transferred into a release position in which it releases the lock body or another actuator for the vehicle part. In the release position, the company emblem at the same time functions as a grip element in order to completely open the vehicle part, for example, a rear hatch of the vehicle. After actuation of the means, it was necessary to return the company emblem into its initial position. This is cumbersome.

It is known to arrange push buttons for interior gauges of motor vehicles under an elastic plastic skin (DE 42 13 084 A1) and to actuate the switches through the skin. The elastic skin serves as a cover of the steering wheel or an arm rest in the vehicle interior. Such a plastic skin cannot be used for the external actuation of doors or flaps of a vehicle. The external actuator of a door must be able to withstand impacts and must be weathering resistant.

It is moreover known to employ for actuation of switches in an arm rest (WO 97/11473) pressure-responsive resistors which are connected to a control module. The pressure-responsive resistors are arranged on the surface of a foam material laver and the foam material layer is covered by a flexible skin which may have a soft outer layer. Upon pressure actuation on the flexible skin, the foam material layer is compressed and this results in a thickness change of the soft cover positioned above the pressure-responsive resistors. Such soft inner covers of the vehicles are not suitable for external actuators of doors.

It is finally also known in the case of inner covers of vehicles (GB 2 161 122 A) to employ membrane switches underneath an elastic foam material layer, wherein the arrangement locations of the switch, for the purpose of visual and touch recognition, are recessed at some locations. The actuation pressure results in a deformation of the recessed locations of the foam material layer which then act on the membrane switch. Such foamed material layers have also been used for rocker actuators or membrane switches (U.S. Pat. No. 5,448,028), wherein projecting areas in the arm rest indicated the position of the switch. This foam material layer was covered by a flexible skin. The pressure actuation resulted in the compression of the laver above the membrane switch or the rocker with regard to its layer thickness which resulted in pressure being exerted onto the switching elements underneath. Such foam material layers which are compressible with regard to their laver thickness are not suitable for the external actuation of doors.

Cushions of elastic material, whose exterior however must be covered by a metallic coating, have been used on grips or buttons positioned on the exterior side of doors (FR 2 217 784 A). In the elastic cushions a switch with a contact maker was integrated. The contact maker was supported on a bracket arranged before the cover. The car body of the door in this area was provided with a depression in order to provide space for the hand. The hand compressed the elastic cushion from behind, i.e., from the interior of the depression. Accordingly, the cushion together with the switch integrated therein was pressed against the bracket underneath the cover. This door actuators are comprised of numerous components. This known door actuators form disturbing components projecting from the car body which can easily soil and are difficult to clean.

The invention has the object to develop a reliable device of the kind mention above which is embodied inexpensively and is easy to manipulate.

The invention has recognized that either the outer skin of the vehicle or a decorative element seated on the outer skin of the vehicle can take over the further novel functions of being the actuator for the switch. According to a first embodiment, a portion of the outer skin itself is used as an actuator for the switch. For this purpose, it is sufficient to make a certain location at the outer skin elastically deformable by pressure loading. This can be realized by a suitable material selection, sizzling or shaping of the outer skin at this location. The outer skin remains smooth at this location relative to the exterior, requires no holes and no inserted parts. It is sufficient to arrange the contact maker of the switch either directly or indirectly within the yielding path of the car body portion. Since holes are no longer required in the outer skin, there are no sealing problems and there is not risk of soiling.

In an analog way, according to another embodiment, a portion of the decorative element itself is embodied to be elastically deformable and fulfills thus the function of an actuator for a switch whose contact maker is again arranged directly or indirectly in the yielding path of the decorative element portion. In this connection, according to FIG. 4, it is beneficial to use the configuration of the decorative element in the form os stays in accordance with the decorative function or the visual information function. The decorative element is in fact divided by stays with intermediately positioned penetrations. The invention has recognized that the stays favor the elastic yielding in a certain portion of the decorative element such that this area is particularly suitable in order to serve as an actuator of the switch. This means that a number of components are no longer needed as they were otherwise required for an actuator provided underneath the decorative element. Moreover, the decorative element must not change at all its initial position in order to trigger the actuator. It is sufficient to press down on the corresponding yielding location of the decorative element in order to obtain the desired switch actuation.

BRIEF DESCRIPTION OF THE DRAWINGS

Further features and advantages of the invention result from the dependent claims, the following description, and the drawings. In the drawings, the invention is illustrated in several embodiments. It is shown in:

DETAILED DESCRIPTION OF THE PREFERRED EMBODIMENTS

Figure 1:
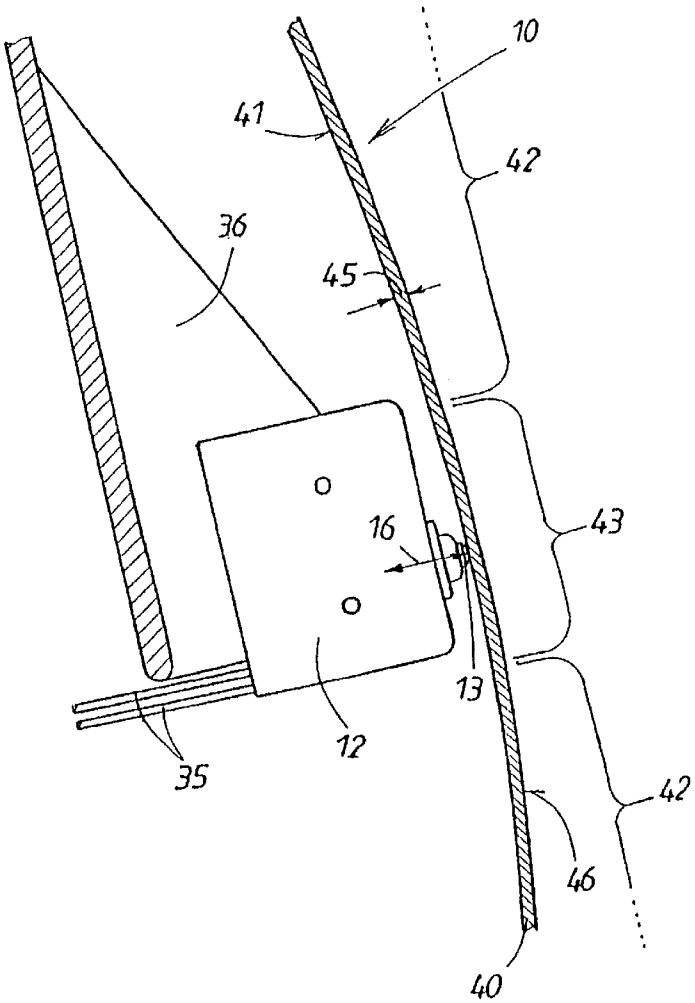
FIG. 1 a longitudinal section of a portion of the outer skin of a vehicle with the actuating location according to the invention, shown in the rest position.

FIG. 1 shows in a longitudinal section a portion of a rear hatch 10 of the motor vehicle which is secured by a lock, not shown in detail, in the closed position. In order to facilitate opening of the lock, a drive, not illustrated in detail, is provided, for example, an electric motor. For switching on or off this drive, a switch 12 is provided which is connected by lines 35 with the drive. In the usually present closed position of FIG. 1 the drive is inactive. The switch 12 is fastened on a support 36 which is integrated into the structure of the hatch 10 in this configuration. A contact maker 13 of the switch 12 is arranged on the backside 41 of the outer skin 40 and should be, if possible, in contact with the backside 41. The contact maker 13 in the present case is comprised of a pin which is longitudinally movable in the direction of arrow 16 and, according to its movement, can perform different switching functions within the switch 12. When the pin 13 is pushed in, the contacts within the switch 12 are closed, and a corresponding switch-on signal is transmitted via lines 35 to the drive.

Several switches 12 can be provided at this location or in the neighboring area which are correlated with further functions in the vehicle, for example, for closing the closure when closing the rear hatch. Such switches 12 can also activate additional functions on the vehicle, such as closing or opening of the doors, the windows and the sliding roof of a vehicle. These different functions can alternatively also be triggered by different magnitudes of the pushing-in movement 16 of the contact maker 13. Between the contact maker 13 of the switch 12 and the backside 41 of the skin, it is also possible to arrange transmission members for the switch actuation so that the switch 12 itself could be fastened at a more beneficial location relative to the outer skin 40 which location is moved farther away.

Figure 2:
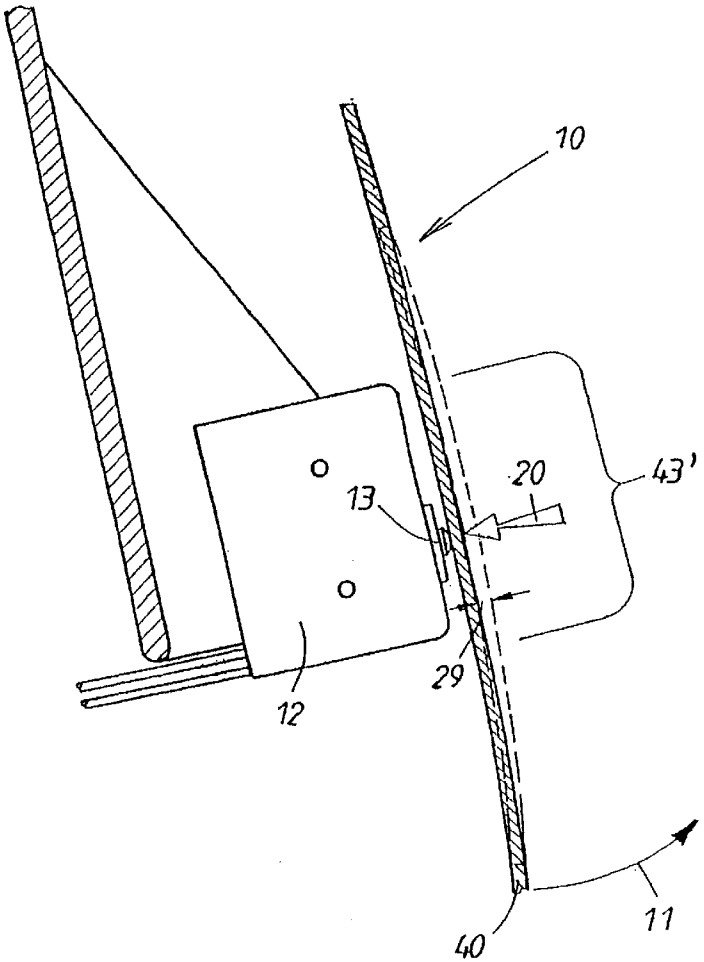
FIG. 2 the device illustrated in FIG. 1 in the situation of pressure actuation.

The location 43 of the outer skin 40 which is substantially aligned with the contact maker 13 is elastically deformable relative to the adjoining neighboring area 42 when pressure is exerted there according to the force arrow 20 of FIG. 2. For short, this location 43 will therefore be referred to in the following as "deformation location" of the outer skin 40. The actuation situation of the deformation location is illustrated in FIG. 2 and the deformation resulting therefrom is indicated at 43'. The yielding path, indicated in FIG. 2 at 29, results in which the contact maker 13 is arranged directly, as mentioned before. The drive is then activated in the described way. The rear hatch 10 can be transferred in the direction of movement arrow 11 of FIG. 2 into the upwardly folded position, not illustrated in detail.

The deformation location 43 is suitably embodied such that upon pressure actuation 20 a defined yielding action is realized. This can be realized by a corresponding shaping of the location 43 and/or by a reduction of the wall thickness 45 of this outer skin 40. Also, weakening of this deformation location 43 by cutouts in the wall of the outer skin 40 would be conceivable. The center of the deformation location 43, which is especially effective for the exertion of the pressure 20, should be marked in a special way at the exposed side 46 of the outer skin 40. The drive, in the actuation situation of the deformation location 23', can be used for a complete opening of the rear hatch 10 without this requiring an auxiliary manual handling. This should also apply in the case of the other embodiments.

Figure 3:
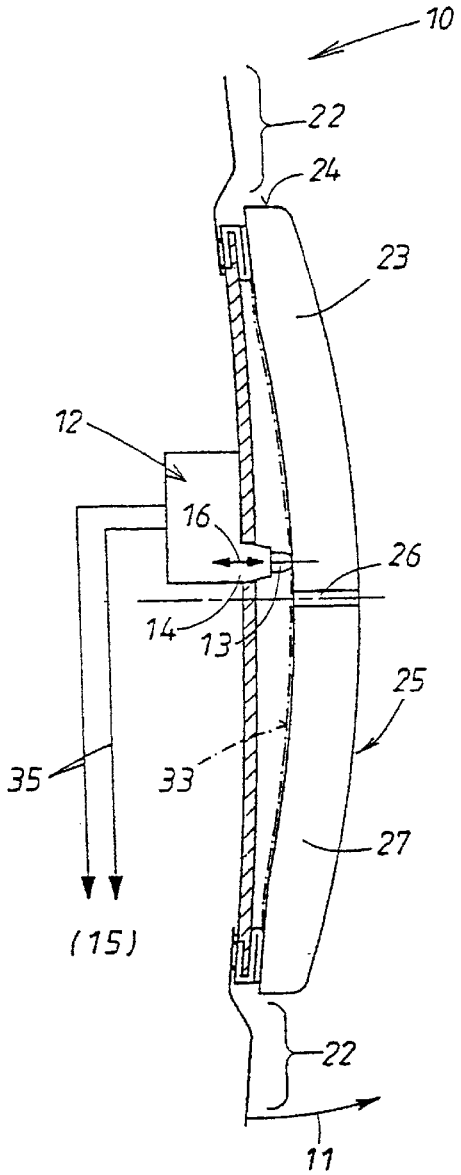
FIG. 3 a first alternative embodiment of the invention, i.e., a longitudinal slot through a portion of a rear hatch of a motor vehicle, shown in the rest position.
Figure 4:
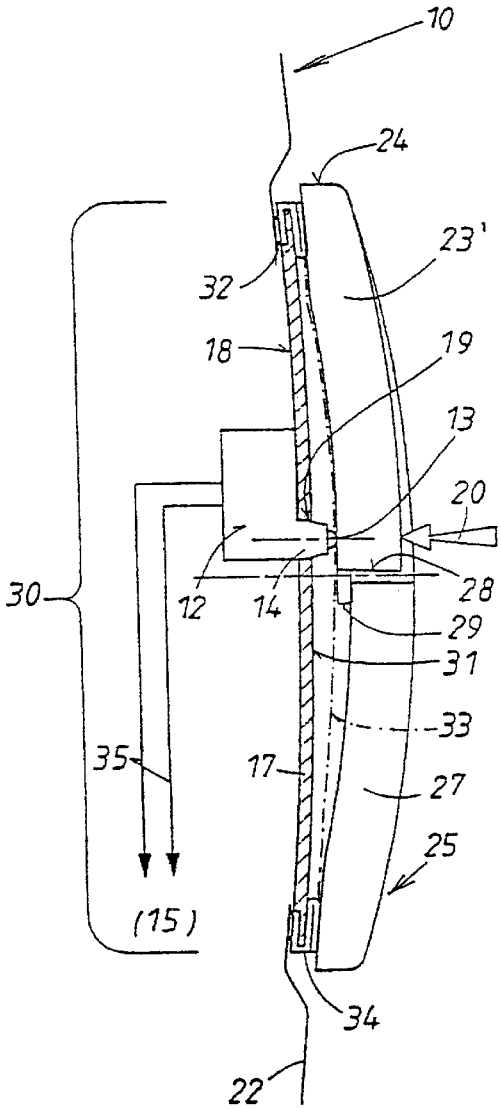
FIG. 4 the device illustrated in FIG. 2 in the actuating situation.

The embodiment according to FIGS. 3 and 4 shows a modification of the lock wherein for identifying corresponding components the same reference numerals as in the preceding embodiment of FIGS. 1 and 2 are used. In this connection, the previous description applies. It is sufficient to discuss the differences.

The actuator for the switch in the present case is a company emblem 25 with a circular contour 24 which has an elastically deformable portion. The company emblem 25 has a logo which is comprised of several stays 23, 27. The stays 23, 27 fulfill a certain decorative function and can also provide a visual information content and can be comprised of letters and/or an image. Between the stays there are penetrations. In the present embodiment there is even a separating cut 26 between two stays 23, 27 which make one stay 23 flexible. The stay 23 is fast at one end in the circumferential area 24, but is flexible at its oppositely positioned free end 28. The stay 23 fulfills the function of a flexible bar. It is deformed in the direction of arrow 20" of FIG. 4 relative to the neighboring stay 27, which is in itself rigid, toward the switch 12 and reaches the position 23'. This is illustrated in FIG. 4 by the deformation travel 29. The company emblem is integrated into a neighboring area 22 of the car body.

As can be seen in FIG. 4, the company emblem 25 belongs to a modular unit 30 which in itself can be completely pre-assembled and comprises the following components. There is first a mounting plate 17 on whose backside 18 the already mentioned microswitch 12 with its housing is fastened. A guide 14 on the switch housing penetrates a penetration 19 provided within the mounting plate 17 so that the contact-providing pin 13 is positioned at the inner side 31 of the mounting plate 17. In front of the contact pin 13 a continuous elastic membrane 33 can be arranged, which is illustrated in FIGS. 3 and 4 only by a dash-dotted line and which is a component of the modular unit 30 and extends over the entire inner side 31 of the plate in a sealing way. The company emblem 25, together with the membrane 33 and a circumferential seal 34, is fixedly connected to the mounting plate 17, for example, by screws. Of course, these fastening screws do not impair the flexibility of the afore described yielding location 23. This modular unit 30 is mounted in the aforementioned neighboring area 22 of the outer skin in a cutout 32, illustrated in FIG. 4.

When the force exertion 20 of FIG. 4 is finished, the elasticity within the company emblem 25 ensures that the car body location returns from its actuating position 23' again into its initial position of FIG. 3. This restoring movement can be supported, if needed, also by additional elastic means such as leaf spring. Normally, this is not required, in particular, because the membrane 33 has a certain restoring elasticity. The membrane 33 has in fact the tendency to return into the curved position illustrated in FIG. 3 which is its stable state.

It is understood that, instead of a company emblem 25, other decorative elements on the outer skin of the vehicle can take over the function of the inventive actuator for a microswitch. For example, it is possible to use decorative parts of a vehicle for this purpose. However, suitable would be also designation parts on the vehicle which are provided anyway, for example, the model designation of the vehicle.

Figure 5:
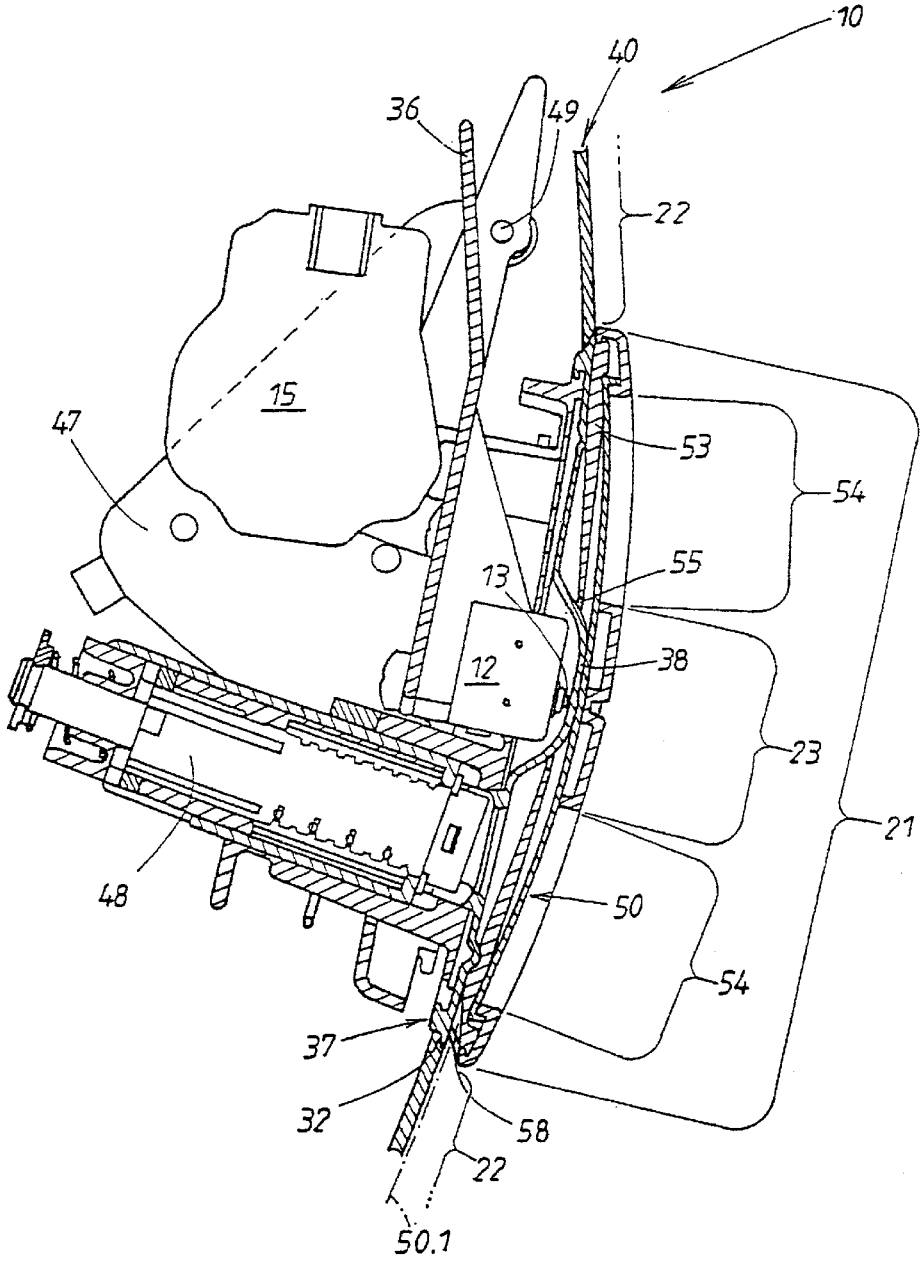
FIG. 5 a further embodiment of the device according to the invention, where the actuatable deformation location is integrated into a company emblem which is seated on the outer skin of a rear hatch of the vehicle, shown in a rest position.
Figure 6:
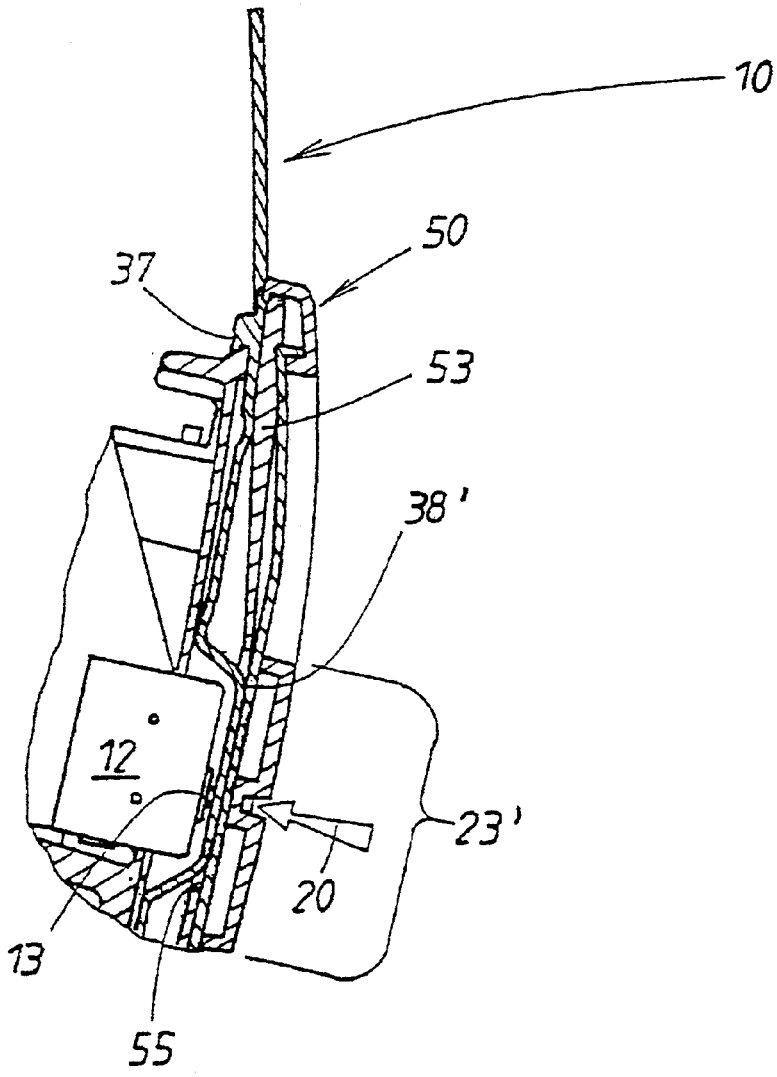
FIG. 6 a detail of the device shown in FIG. 5 during its pressure actuation.
Figure 7:
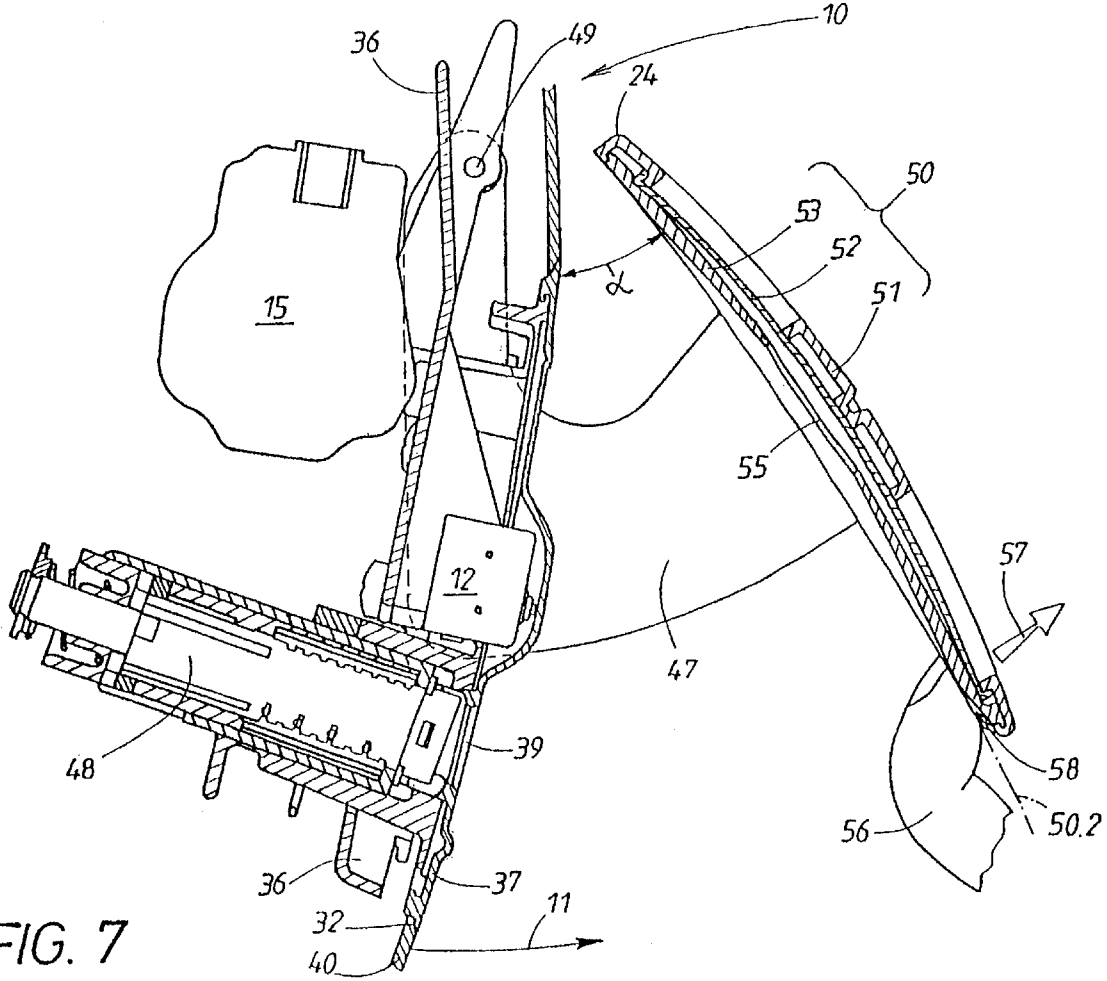
FIG. 7 the spaced position of the company emblem resulting from the pressure actuation of FIG. 6 and now serving as a hand grip for completely opening the flap.

In the third embodiment of FIGS. 5 through 7, a modular unit 21 comprised of an attachment 50 and an insert 37 is provided, wherein a company emblem 51 is integrated also in the attachment 50. This modular unit 21 is pre-manufactured and mounted in the neighboring area 22 of the car body. In contrast to the preceding embodiment of FIGS. 3 and 4, the company emblem 51 integrated into the attachment 50 is movable by the same motor 15 which also serves for actuating the lock which is not illustrated in detail. FIG. 7 shows the spaced position 50.2 where the attachment 50 has an angle $\alpha$ of approximately 45° relative to the contact position 50.1 in FIG. 5.

The insert 37 on the other hand remains stationary. It forms the inner layer of this modular unit 21, is comprised of elastomeric material, and is seated in a cutout 32 of the outer skin 40. this inner layer 37 forms an elastic seal and has a central dome 38 in front of the contact maker 13 of a switch 12 which is seated on the support 36. In a paced position according to FIG. 7, a closing cylinder 48, which in an emergency situation allows for a key actuation of the rear hatch lock, is accessible through an opening 39 in the inner layer 37. the closing cylinder 48 is mounted on the support 36. On the support 36 two levers 47 are connected at 49. The levers 47 support the attachment 50.

As can be taken best from FIG. 7, the attachment 50 itself is of a multi-layer configuration comprised of the outer company emblem 51, a membrane 52 arranged at the backside thereof and having elasticity of extension, and a shape-stiff grip plate 53 which is comprised of metal. The company emblem 51 is comprised of a relatively shape-stable material, i.e., plastic, but has penetrations 54 which provide in the central area of this outer layer 51 a sufficient elasticity of flexure. The company emblem 51 is three-dimensional and has penetrations 54 in the relief between the lettering and the image. The penetrations 54 are closed at the backside by the expandable membrane 52 and are thus sealed. The grip plate 53 positioned underneath is seated on the free ends of the levers 47 and has a hole 55 at a defined location. The three layers 51, 52, 53 of the attachment 50 are fixedly connected to one another at their periphery 24. At the central area of the attachment 50 a sufficient spacing is provided between the grip plate 53 and the flexible layers 51, 52 positioned above.

Normally, the contact position 50.1, which is indicated in FIG. 5 by an auxiliary line 50.1, is present where the modular unit 21 is positioned closely at the inner layer 37 within the cutout 32 of the outer skin 40. In this case, the central dome 38 of the elastic inner layer 37 projects through the hole 55 of the grip plate and, as illustrated in FIG. 5, is aligned with a yielding location 23 of the company emblem 51. The yielding action is recognizable for the pressure actuation 20 illustrated in FIG. 6. In the company emblem 51 the yielding location 23 is transferred into the pushed-in position 23' illustrated therein where the dome of the elastic inner layer 37 positioned behind has been pushed into the area of the grip plate hole 55 and thus has suffered a flattening 38'. Accordingly, the contact maker 13 is pushed in and the switch 12 actuated. The grip plate 53 limits the pressure actuation 20 of the actuated deformation location 23' according to FIG. 4.

The actuation of the switch 12 activates the drive 15 by means of an electronic control, not illustrated in detail, which drive, as mentioned already above, first transfers the lock of the rear hatch 10 into a ready position for opening. The same motor drive 15, expediently after a short delay, is also used for movement of the modular unit 50. This movement is realized via the levers 47 which are pivoted outwardly. This results in the already aforementioned spaced position of FIG. 7 which is indicated therein by the auxiliary line 50.2. Now the grip plate 53 can be engaged from behind by a human hand 5.6 in order to transfer the rear hatch 10 in the direction of movement arrow 11 of FIG. 7 into the completely open position. For this purpose, the opening force which is illustrated by the force arrow 57 is provided.

From its spaced position 50.2 the modular unit 50 is returned manually or by a motor drive into, its contact position 50.1 of FIG. 1. This can also be performed automatically upon closing of the rear hatch.

The device according to FIG. 3 to 5 could also be integrated as an immobile attachment 50 or as an insert into the outer skin 40 when the function of a hand grip according to FIG. 5 is not to be utilized. In this case, the grip plate 53 and the lever 47 can be eliminated. however, the outer layer 51 as the company emblem remains in place behind which sealing layers 52 and/or 37 are positioned and which acts through the actuating pressure 20 according to FIG. 4 in the already described way on the contact member 13 of the switch 12.

Should the electrical devices of the vehicle be defective and the switch 12 and the drive 15 therefore not be functioning, the rear hatch 10 can still be opened. The attachment 50 has, as illustrated in FIGS. 5 and 7, in the lower area a rearward cutout 58 which is accessible for the fingertips of a human hand. By a manual pulling action, the levers 47 can then be decoupled from a locking position coupled with the motor 15 and make possible a manual pivoting of the modular unit into the spaced position illustrated in FIG. 7. As already mentioned, the end face of the closing cylinder 48, which is normally positioned below the modular unit 50, is then accessible through the opening 39 of the inner layer 37 and makes possible the opening of the rear hatch, as already mentioned, by means of an emergency key.

Figure 8:
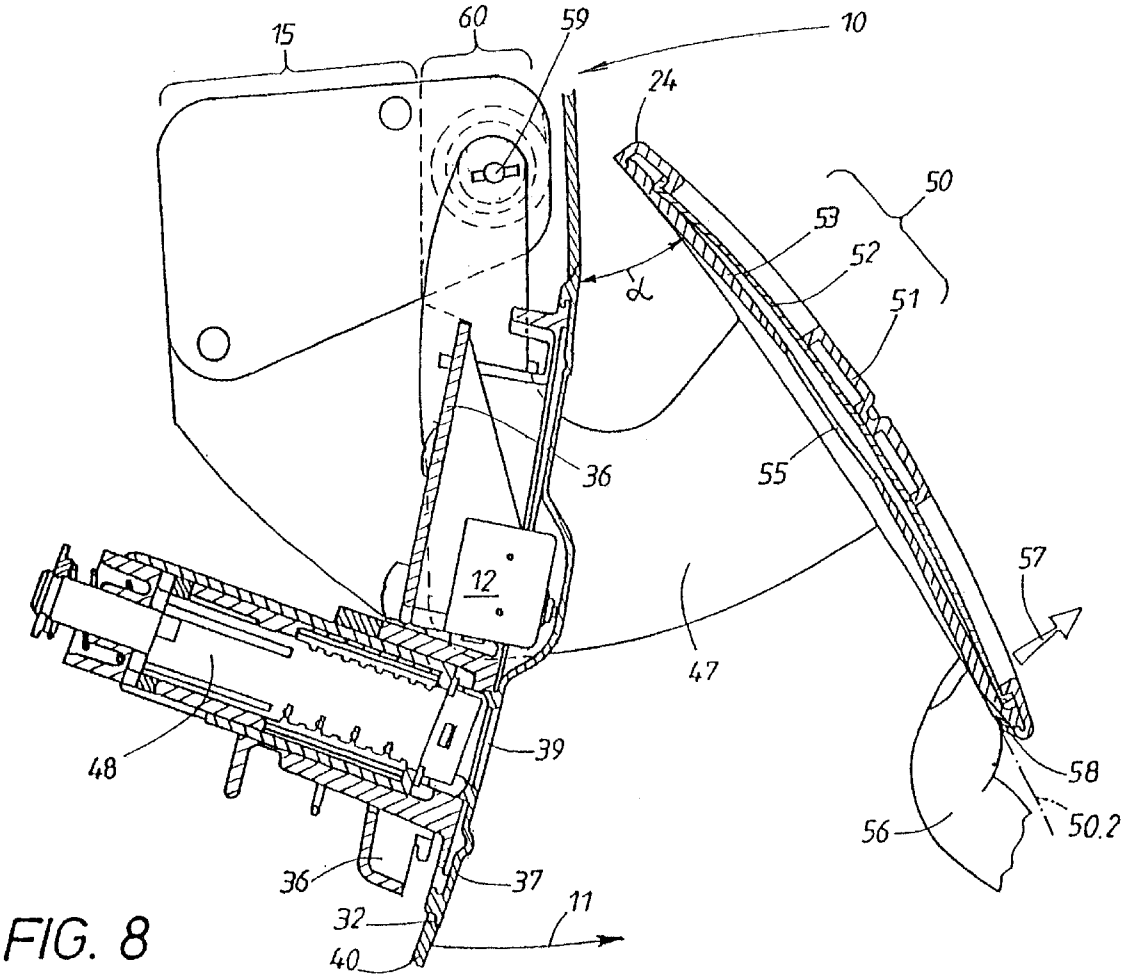
FIGS. 8+9 two modified embodiments of the device illustrated in FIGS. 5 through 7 when the company emblem is in a spaced position.

In FIG. 8 a modification of the device of FIGS. 5 through 7 is illustrated. It is sufficient to only discuss the differences while in other respects the description provided above applies. In this case the levers 47 are connected fixedly to a bearing shaft 59 for common rotation. The shaft 59 is driven by a transmission 16 which is arranged downstream of the motor 15.

The emergency situation described in the preceding embodiment can be applied also in this modification of FIG. 8. In this case, between the bearing shaft 59 and the transmission 60 a locking coupling is provided which can be, for example, a magnetic coupling which acts by means of permanent magnets. By exerting a sufficiently great opening force, the magnetic coupling is decoupled and the levers 47 reach a "freewheeling" position.

Figure 9:
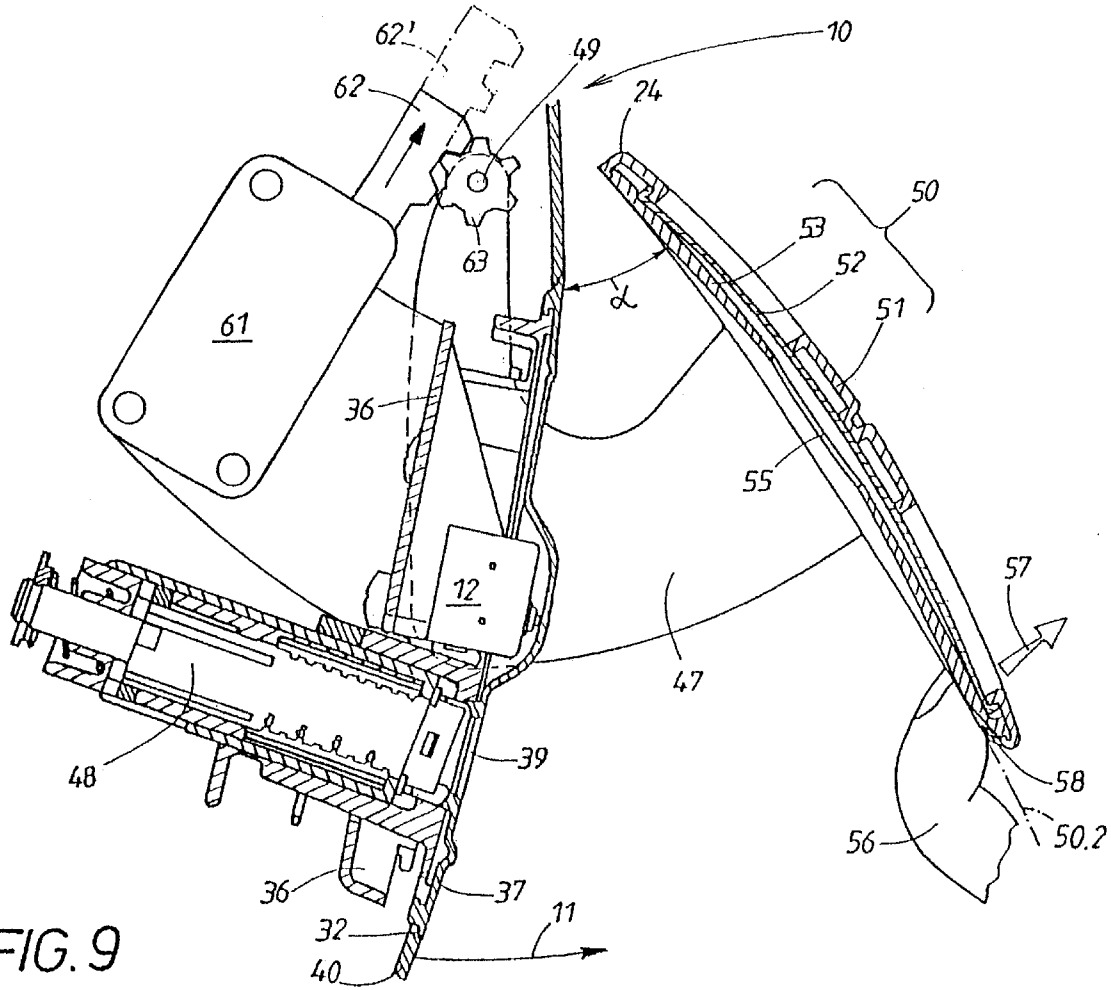

In the embodiment of FIG. 9, a drive 61, modified in comparison to FIG. 8, is illustrated which is comprised of a motor, in particular, an electric motor and a transmission. Here, the output member of the transmission is a tooth rack 62 which engages a gear wheel 63. The gear wheel 63 is fixedly connected with the levers 47 and pivotable together with them about their connecting location 49.

FIG. 9 shows in solid lines the inserted position 62 of the tooth rack. Its retracted position 62' is illustrated in dash-dotted lines. It is present when the attachment 50 is positioned in the contact position illustrated in the second to last embodiment of FIG. 5. In this case, in an emergency situation it is possible to manually move away the attachment 50 from the outer skin 40. For this purpose, it is sufficient to employ a double tooth rack or to employ again the afore described magnet coupling between the movable transmission parts.

What is claimed is:

1. A device for actuating an opening mechanism and/or a closing mechanism of lockable movable parts on vehicles, wherein, when the lockable movable parts are in an open position, the lockable movable parts allow access to at least certain areas within an interior of the vehicle, the device comprising a manual actuator which in an activated position acts on at least one contact maker of at least one switch, wherein the actuated switch switches on a drive for opening or closing the movable vehicle part, an outer skin mounted on the vehicle or on the movable vehicle part, a decorative element mounted in front of, on and/or in the outer skin, the decorative element having decorative character and/or an information content, wherein the decorative element is divided according to the decorative character and/or the information content into stays and penetrations positioned between the stays, and wherein at least one portion of the stays is elastically yielding and forms the actuator for the switch.

2. The device according to claim 1, wherein the contact maker of the switch is arranged either directly or indirectly via transmission members in a yielding path of the decorative element portion.

3. The device according to claim 1, wherein the decorative element has a contact-providing stay which is flexible and acts in a contact-providing way on the switch.

4. The device according to claim 3, wherein at least one separating cut is arranged between neighboring stays of the decorative element, and wherein the separating cut increases the elasticity of flexure of the stay or stays acting as the switch actuator.

5. The device according to claim 1, wherein the decorative element is comprised of an insert or an attachment which is movable relative to the outer skin between at least two positions, wherein the attachment, after pressure actuation of the yielding stay, is movable from a substantially flush or parallel contact position relative to the surrounding area of the outer skin into a projecting spaced position, and wherein the attachment, which projects when in the spaced position, forms a hand grip for manually fully opening or closing the movable vehicle part.

6. The device according to claim 5, wherein the insert or attachment is foldable relative to the neighboring area of the outer skin and is positioned at an angled position when in the spaced position.

7. The device according to claim 5, wherein the spaced position of the decorative element is a ready position for opening from where a completely opened position of the vehicle part is realized by a further manual movement.

8. The device according to claim 5, wherein the attachment, when in a projecting position, is movable after a renewed actuation from the spaced position into the contact position.

9. The device according to claim 5, wherein a reversal of movement of the attachment between the contact position and the spaced position is effected by a drive, wherein the drive also serves for opening or closing the movable vehicle part or a corresponding lock.

10. The device according to claim 9, wherein a lever supporting the attachment or insert is fixedly connected to a bearing shaft for common rotation, and wherein the bearing shaft is movable by a motor or transmission of the drive.

11. The device according to claim 9, wherein the attachment or insert has an axis, and wherein the attachment or insert is fixedly connected in an area of the axis to a gear wheel for common rotation, and wherein the gear wheel engages a tooth rack and the tooth rack is longitudinally movable by the motor or transmission arranged downstream of the motor of the drive.

12. The device according to claim 5, wherein a locking coupling is connected within members of the drive extending to the attachment or insert, wherein the locking coupling in a normal situation is engaged and makes possible a motor-driven movement of the attachment or insert, and wherein the locking coupling in an emergency situation is automatically releasable in order to transfer the attachment or insert manually from the contact position into the spaced position.

13. The device according to claim 12, wherein the locking coupling act magnetically.

14. The device according to claim 5, wherein the attachment or insert of the outer skin has several locations which are effective for actuation of one or more contact makers of one or more switches, and wherein the several actuating locations perform different functions on the vehicle.

15. The device according to claim 14, wherein one actuation location serves for opening and another actuation location serves for closing the movable vehicle part and/or wherein the actuation locations serve for performing a movement of the attachment or insert between the contact position and the spaced position.

16. The device according to claim 5, wherein the switch responds by means of the contact maker to different magnitudes of deformation of the actuation location, and wherein different deformations of the actuation location trigger different functions in the vehicle.

17. The device according to claim 16, wherein the attachment or insert forms a modular unit mountable together on the outer skin of the vehicle.

18. The device according to claim 5, wherein a stationary insert is arranged under the movable attachment in the outer skin, and wherein the insert and attachment comprises at least over areas thereof several layers which, upon pressure actuation, are commonly deformable but separate with respect to their layers.

19. The device according to claim 18, wherein an inner layer of the insert is comprised of elastomeric material and sealingly covers a cutout in the outer skin of the vehicle, and wherein the contact maker and the switch and further functional parts of the vehicle are arranged in an area of the cutout.

20. The device according to claim 18, wherein, on a backside of the outer layer of the attachment provided with stays and penetrations, a membrane having elasticity of extension is arranged which closes empty spaces of the penetrations.

21. The device according to claim 5, wherein a layer of the insert or attachment is comprised of a shape-stiff material, and wherein the layer form s a plate which is rigid, and wherein the plate has a hole through which, in the actuation situation, the pressure actuation force is transmitted onto a deformable area of a further layer arranged underneath.

* * * * *